US005832804A

United States Patent [19]

Dudley et al.

[11] Patent Number: 5,832,804

[45] Date of Patent: Nov. 10, 1998

[54] APPARATUS FOR FACILITATING CUTTING OF AN OBJECT

[76] Inventors: Gordon E. Dudley, 8242 E. Redfield, Scottsdale, Ariz. 85260; George F. Roehlk, 25804 Texas Ct., Chandler, Tex. 85248

[21] Appl. No.: 751,150

[22] Filed: Nov. 15, 1996

Related U.S. Application Data

[60] Provisional application No. 60/006,951 Nov. 17, 1995.

[51] Int. Cl. [6] ..... B26D 3/30

[52] U.S. Cl. ..... 83/870; 83/167; 83/454; 83/762; 83/932; 269/87.2; 269/288

[58] Field of Search ..... 83/167, 454, 761, 83/762, 763, 764, 765, 870, 932; 269/87.2, 288, 295, 297; 220/338, 340, 342, 343, 345

[56] References Cited

U.S. PATENT DOCUMENTS

| | | | |
|---|---|---|---|
| 1,098,941 | 6/1914 | Collins | 83/762 |
| 2,172,538 | 9/1939 | Katzinger | 83/454 X |
| 2,474,171 | 6/1949 | Swanson | 83/762 |
| 2,679,274 | 5/1954 | Criner . | |
| 2,765,949 | 10/1956 | Hillman | 220/338 |
| 3,347,296 | 10/1967 | Rothman . | |
| 4,249,445 | 2/1981 | Browning | 83/762 |
| 4,399,989 | 8/1983 | Baillie | 269/87.2 |
| 4,550,636 | 11/1985 | Josselson et al. | 83/743 |
| 4,747,331 | 5/1988 | Policella | 83/762 |
| 4,807,505 | 2/1989 | Campbell et al. | 83/454 |
| 5,577,430 | 11/1996 | Gunderson et al. | 83/762 X |
| 5,611,266 | 3/1997 | Kensrue | 83/762 X |
| 5,664,474 | 9/1997 | Punt | 83/761 |

*Primary Examiner*—Eugenia Jones
*Attorney, Agent, or Firm*—Snell & Wilmer L.L.P.

[57] ABSTRACT

An apparatus for cutting includes a blade guide for guiding a cutting instrument and a tray having an adjustable height with respect to the blade guide. The item to be cut rests on the tray in the path of the blade guide. A blade, such as a knife, is passed through the blade guide and the item on the tray. A blade stop positioned adjacent the blade guide stops the passage of the blade at the appropriate position. A cover assists in holding the item in place, and the plane the blade guide is suitably tilted to facilitate a natural cutting motion.

14 Claims, 10 Drawing Sheets

FIG. 5A
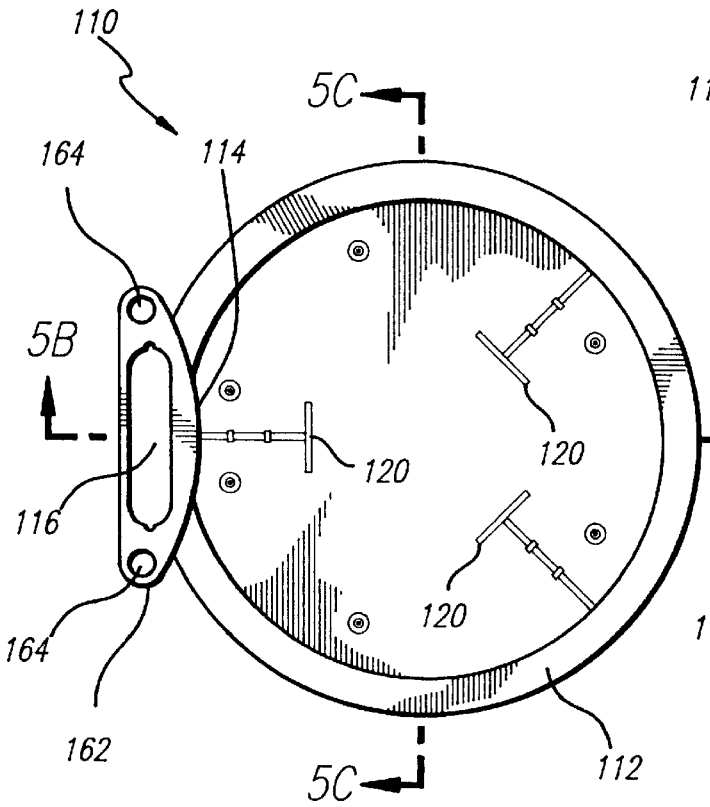
FIG. 5C
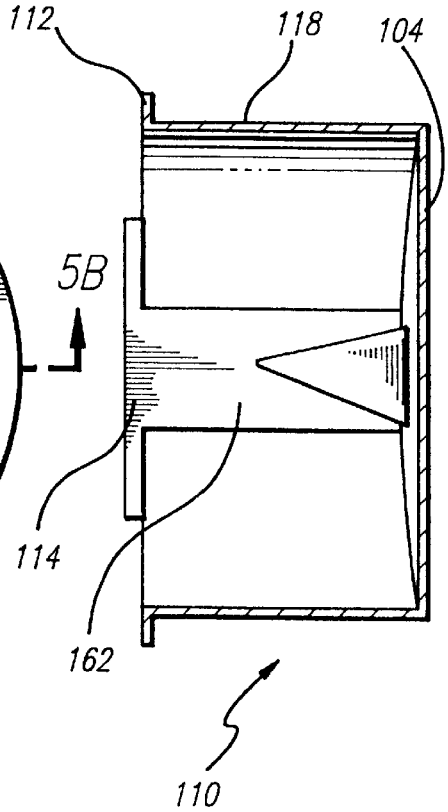
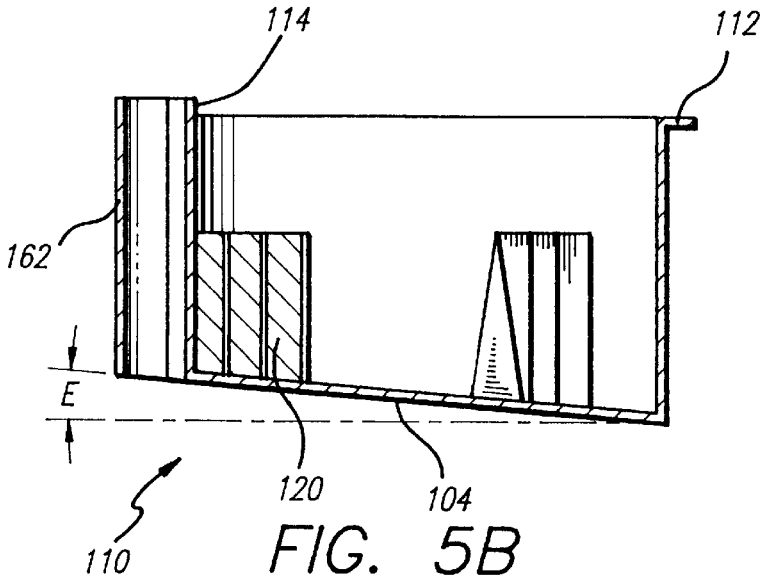
FIG. 5B

FIG. 6A
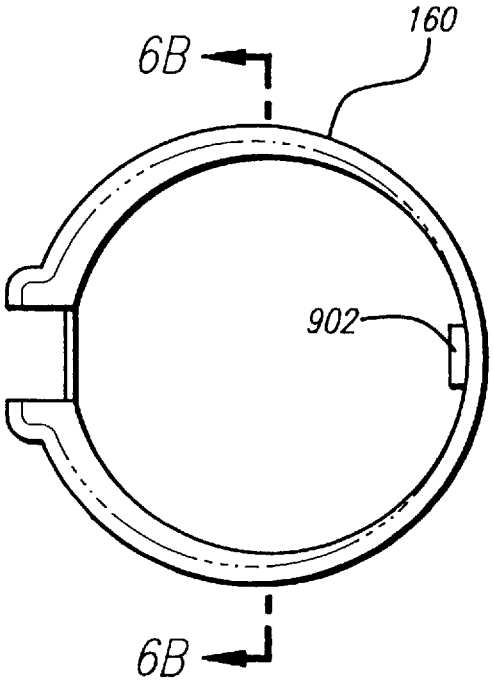
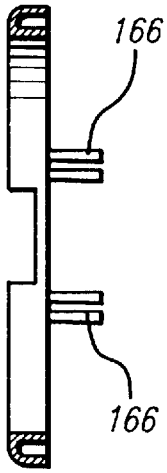
FIG. 6B
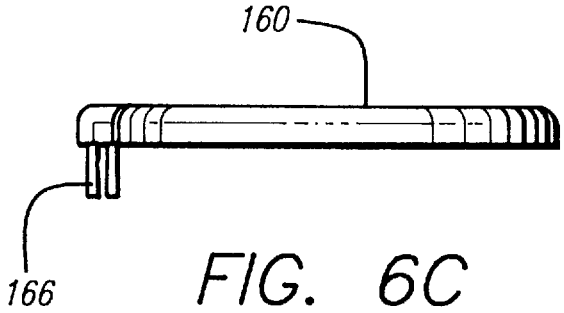
FIG. 6C

APPARATUS FOR FACILITATING CUTTING OF AN OBJECT

CROSS-REFERENCES TO RELATED APPLICATIONS

This application claims the benefit of U.S. Provisional application Ser. No. 60/006,951, filed Nov. 17, 1995.

BACKGROUND OF THE INVENTION

1. Field of the Invention

The present invention relates, generally, to devices for providing even, horizontal, adjustable cuts through objects and, more particularly, to methods and apparatus for cutting foodstuffs by guiding a blade horizontally.

2. Description of the Related Art

Bagels, croissants, English muffins and various other bread products and foodstuffs are among the most popular and commonplace foods in the home, especially for breakfast. Preparing such foods is easy and fast. Favorite preparations include cutting the foodstuff in half, and adding some sort of spread, whether it is butter, jelly, cream cheese, or the like, often after toasting. Typically, the foodstuff is cut in a manner to maximize the surface area available for the spread. For example, a bagel is typically cut along the plane of its circumference to produce two halves of the same diameter, but only half as thick as the whole bagel.

Although slicing a bagel or other foodstuff into halves sounds simple, those familiar with the task know that it is not. Most people attempt to cut the item in two with a knife on a countertop, cutting board or while grasping the bagel in their hands. Only rarely does this method produce a clean cut and two halves of equal size. Instead, the cut tends to wander as the would-be baker tries to drive the knife through the bagel. Most are also loath to guide the knife any closer than necessary, as a sharp knife making its way through a bagel exhibits an uncanny affinity for the hands and fingers of the unwary. Typically, the result of the conventional practice is two slices of bagel, which are rarely of equal size, having rough, ugly cuts across their spreading surfaces, as well as a scattering of crumbs. This not only cheats one partner if the bagel is shared, but the larger piece may not fit into the slots of a toaster. The unfortunate baker is thus forced to eat the bagel cold (hopefully without a slight seasoning of blood), or trim the excess material from the slice, often wasting food and placing the fingers at risk once again.

The difficulty of producing a clean cut through foodstuffs is not limited to bagels or even bread products, but is commonly encountered in preparing fruit, vegetables, and other items. Nor is the problem confined to the domestic kitchen, for slicing equipment typically found in professional kitchens either seems excessive for the job of slicing a little bagel, is too cumbersome and slow, or is otherwise occupied by other staff. As a result, professionals and amateurs alike are left to the conventional knife and cutting board (or hands) and the associated troubles.

SUMMARY OF THE INVENTION

A cutting method and apparatus according to various aspects of the present invention produces a clean, fast, and even cut through foodstuffs and the like. As a result, foodstuffs and the like may be cut into slices of a preselected size quickly and cleanly. The preselected size may be adjusted to a desirable thickness. In addition, a receptacle for crumbs provides for easy clean up.

In particular, a suitable apparatus according to various aspects of the present invention includes a body having a blade guide and a tray to support the item to be cut. The height of the tray within the body may be adjustable to change the location of the item to be cut with respect to the blade guide. A knife or other suitable cutting instrument is then driven through the blade guide and the item on the tray, providing a clean, even cut.

BRIEF DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the claims and the accompanying drawing, in which:

FIGS. 5A–D are top, side cross-sectional, front cross-sectional, and exploded views, respectively, of an alternative exemplary body;

FIGS. 6A–C are top, side cross-sectional, and front cross-sectional views, respectively, of a collar of the cutting apparatus;

DETAILED DESCRIPTION OF PREFERRED EXEMPLARY EMBODIMENTS

In accordance with various aspects of the present invention, methods and apparatus are described for cleanly and evenly cutting objects such as foodstuffs. While the present invention is, of course, versatile enough to be used in slicing a variety of different objects, an exemplary embodiment that is suitable for cutting bread products, such as bagels and the like, is described herein.

Figure 1:
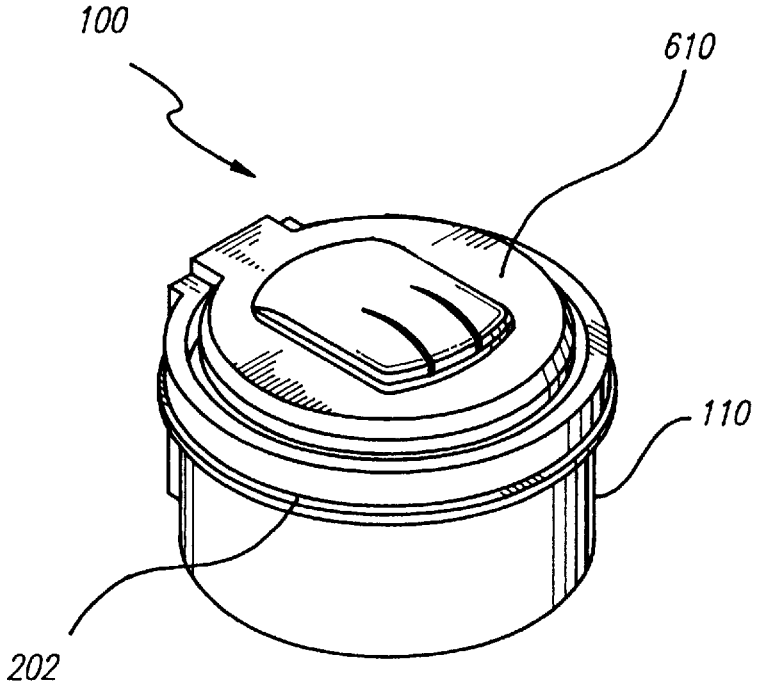
FIG. 1 is an isometric view of a cutting apparatus according to various aspects of the present invention.
Figure 2:
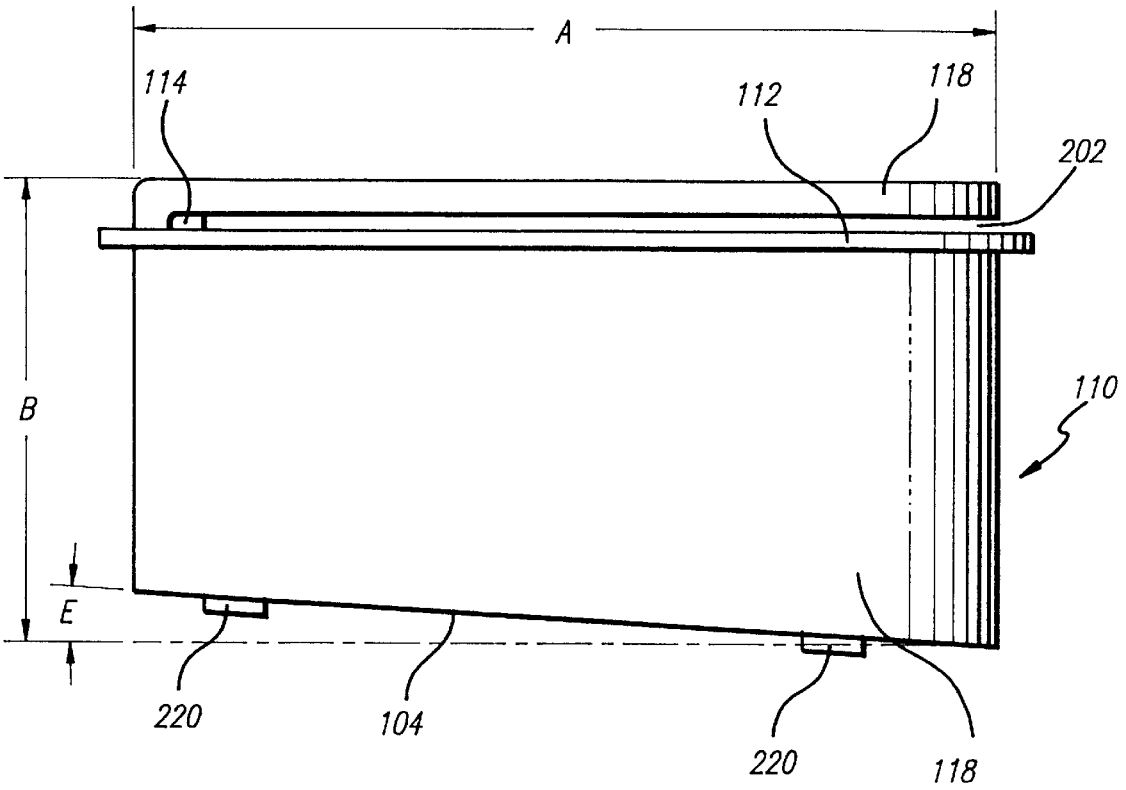
FIG. 2 is a side view of an exemplary body of a cutting apparatus.
Figure 3:
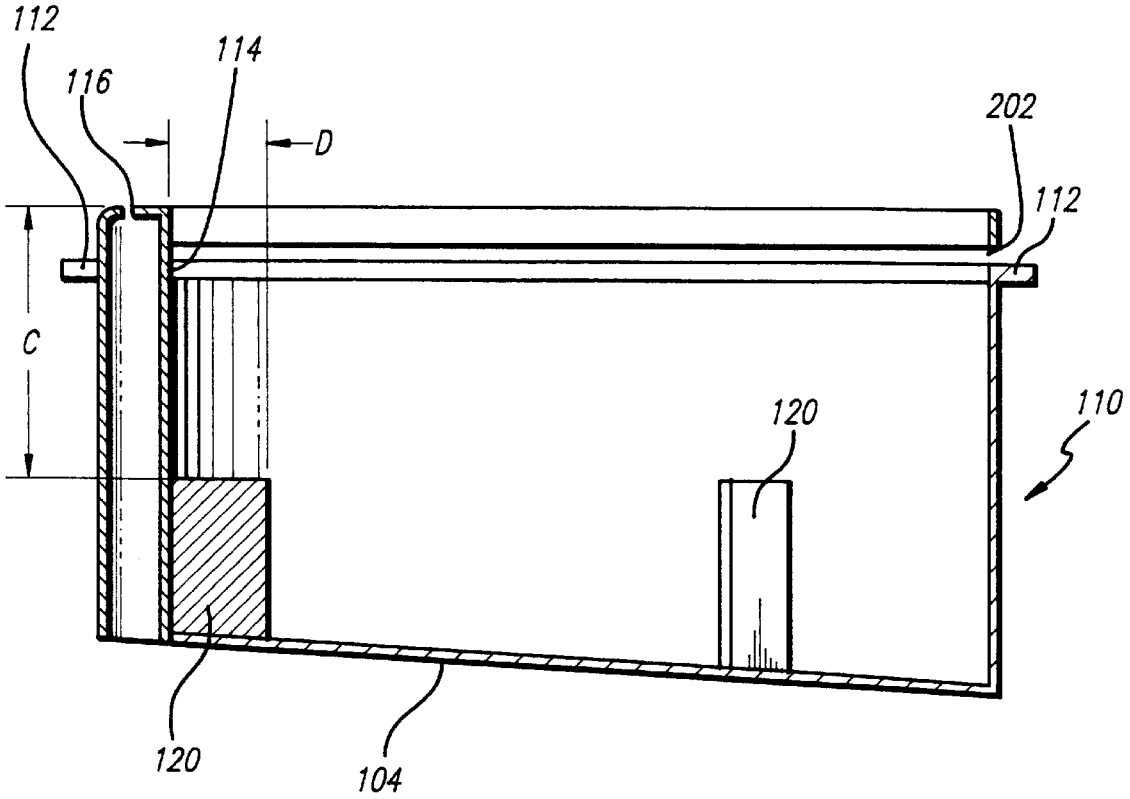
FIG. 3 is a cross-sectional view of the body of FIG. 2.
Figure 4:
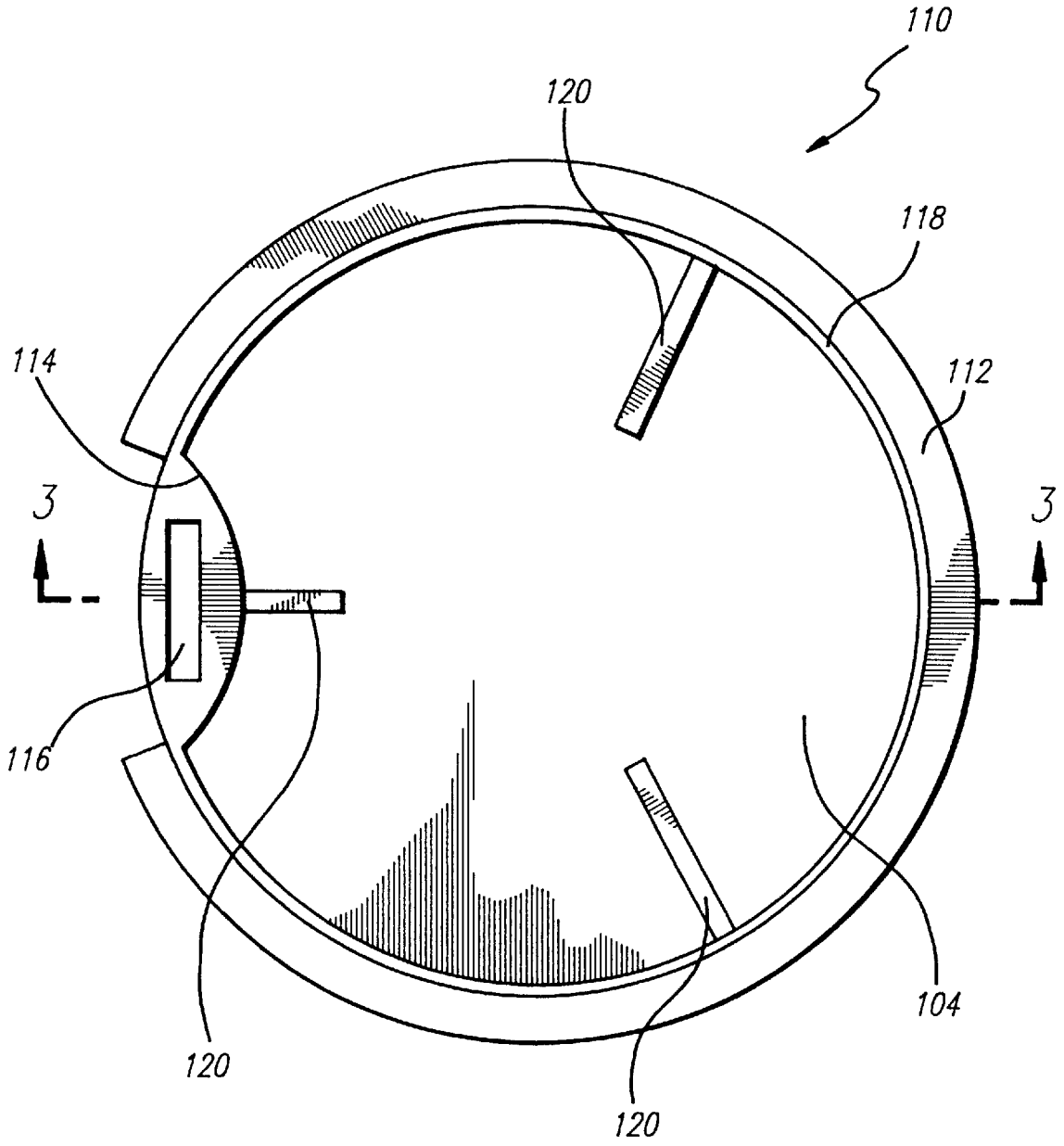
FIG. 4 is a top view of the body of FIG. 2.
Figure 5D:
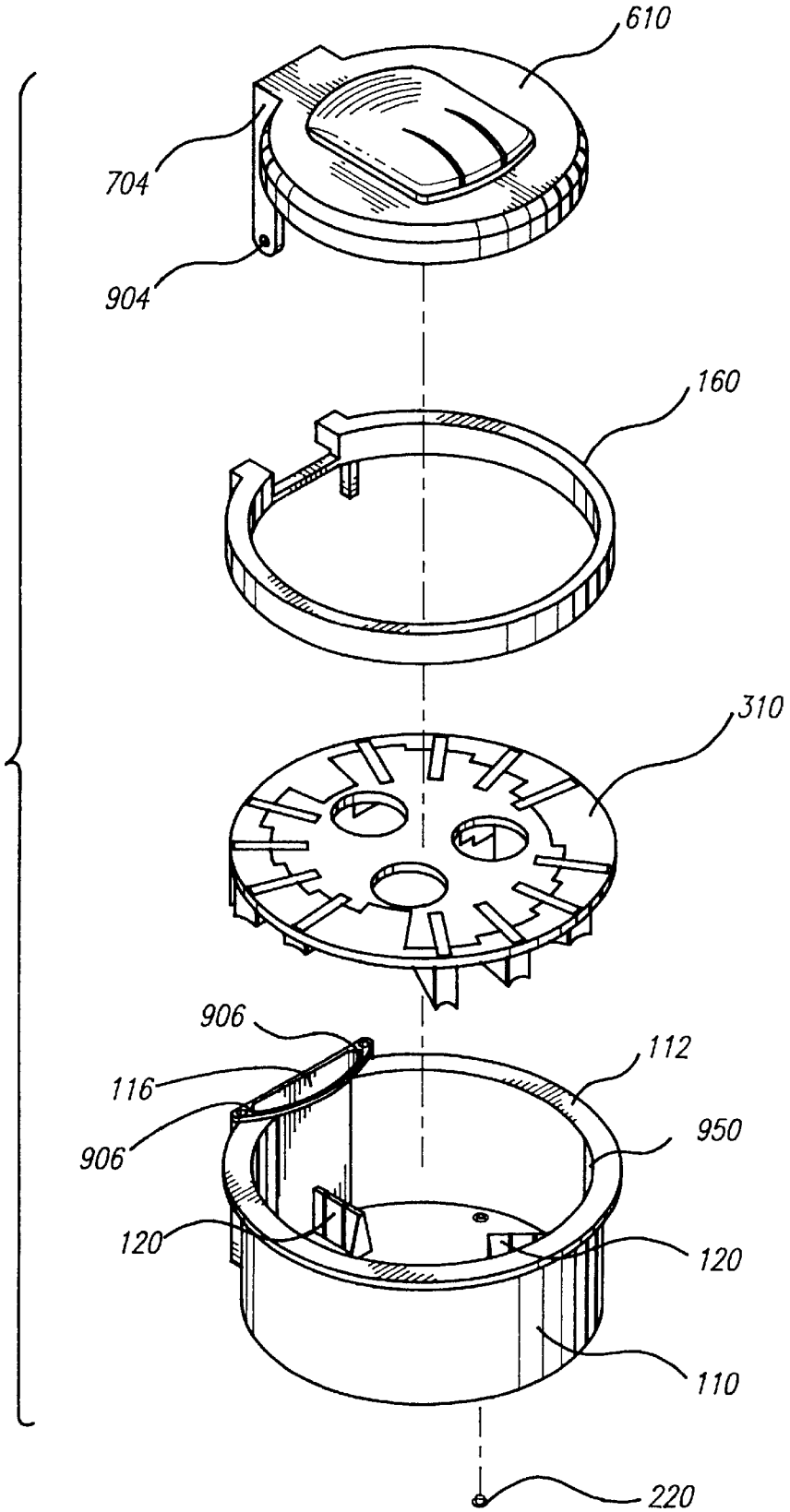
Figure 7B:
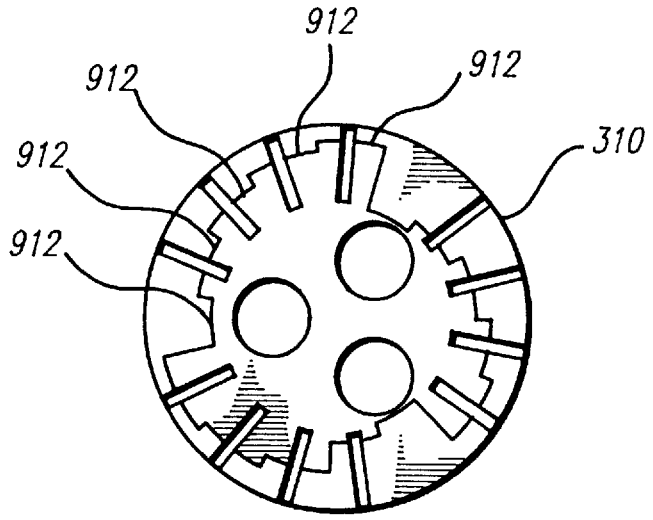
FIGS. 7A–D are bottom, top, side cross-sectional, and detail views, respectively, of a tray of the cutting apparatus.
Figure 7C:
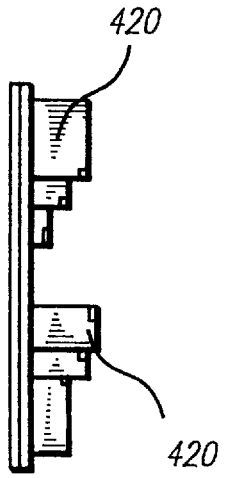
Figure 7A:
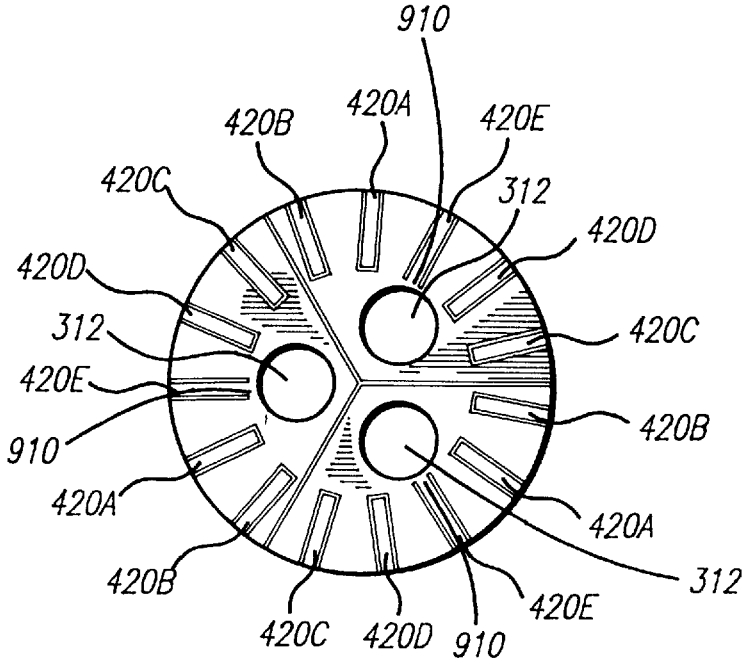
Figure 7D:
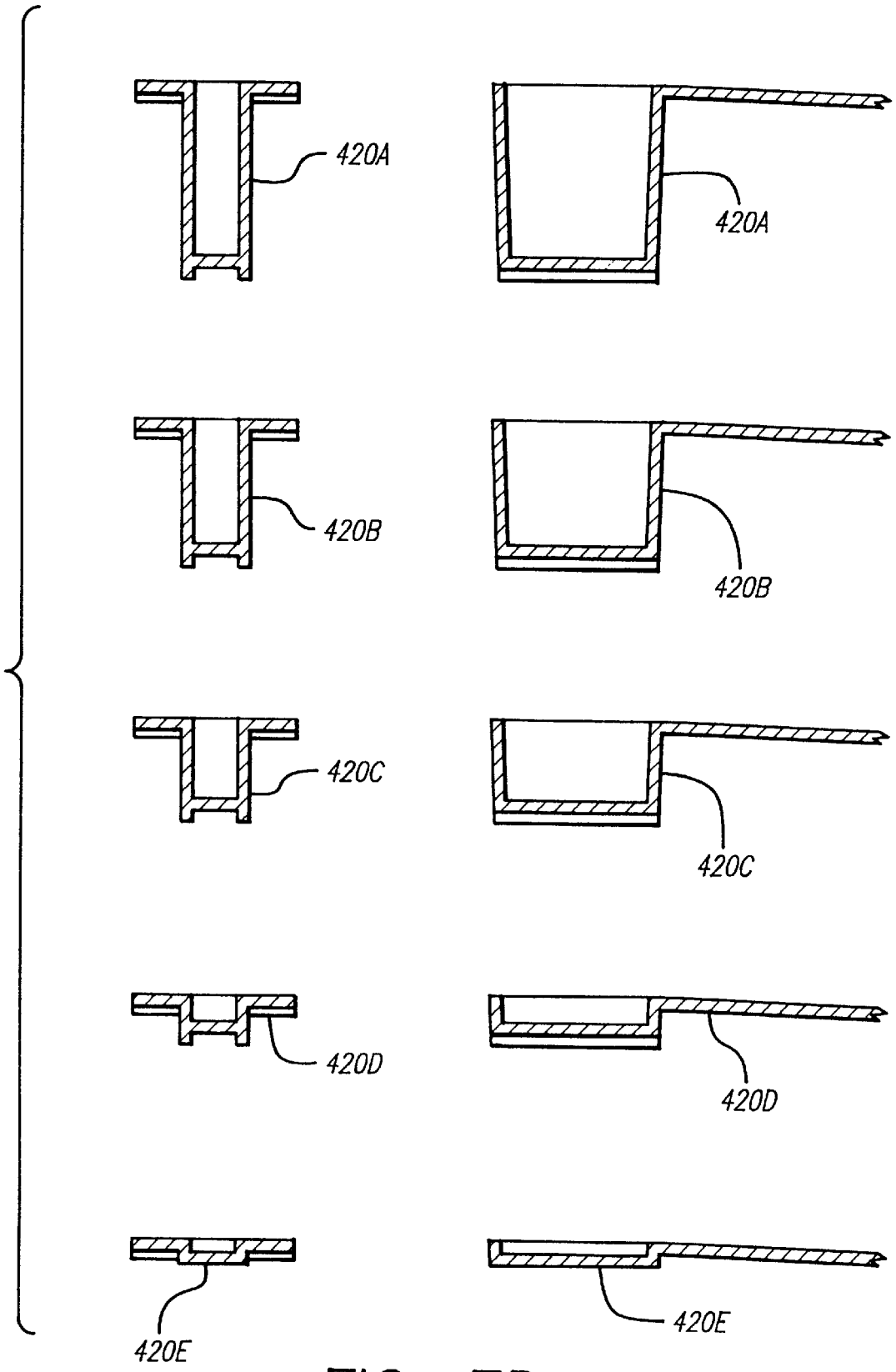
Figure 8D:
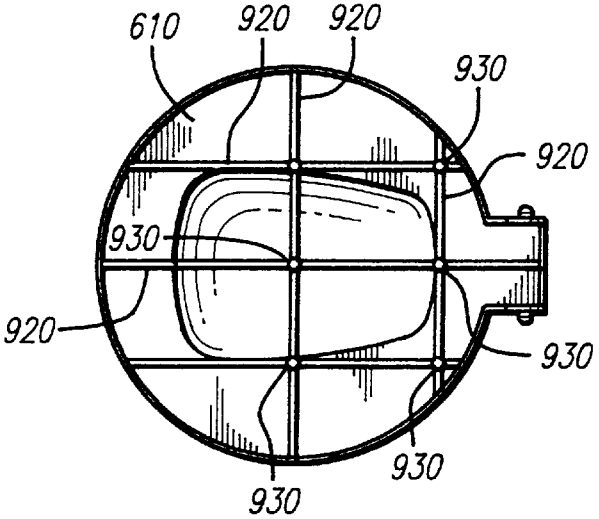
FIGS. 8A–D are top, side, front, and bottom views, respectively, of a cover of the cutting apparatus.
Figure 8C:
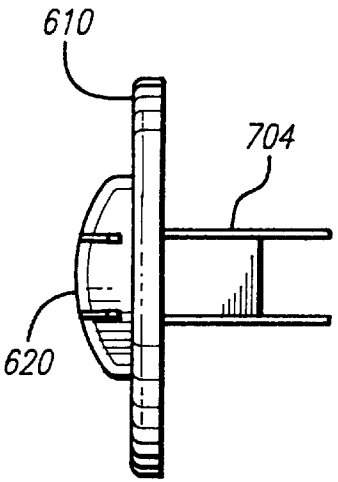
Figure 8A:
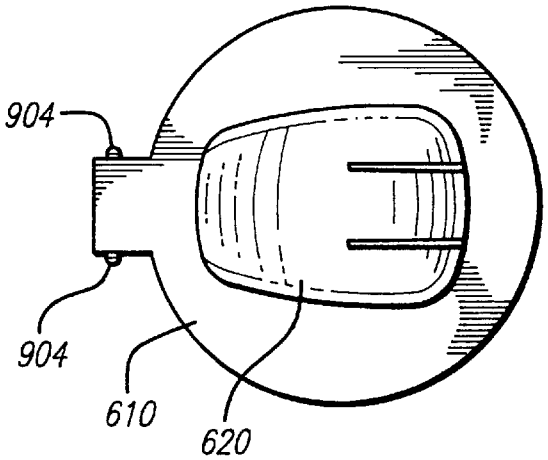
Figure 8B:
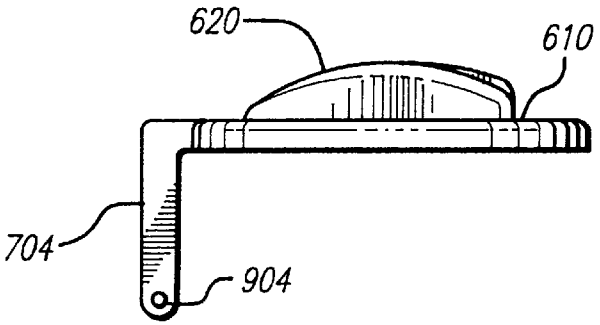

Referring now to FIGS. 1–4, in accordance with an exemplary embodiment of the present invention, a cutting apparatus 100 comprises: a body 110 for retaining an object to be cut and for guiding a cutting edge of a sharp instrument through the object, a tray 310 (see, e.g., FIG. 5D) for holding the object to be cut at an appropriate height within the body, and a cover 610 for securing objects of various sizes and thicknesses within body 110 and tray 310 and for keeping hands and fingers away from the cutting edge of the sharp instrument.

An exemplary body 110 in accordance with various aspects of the present invention is suitably configured to retain an object for slicing. Body 110 suitably includes at least one side 118 and a base 104, and is suitably comprised of a resilient material, for example plastic. Side 118 or portions thereof are suitably transparent or translucent to allow the user to see the object to be cut. Alternatively, slots or other opens areas may be formed in side 118. Side 118 is formed in any of a variety of shapes (e.g. rectangular, elliptical, tear drop, and the like); however, in the exemplary embodiment, side 118 is cylindrical to correspond to the typical shape of foodstuffs such as bagels. A distance across body 110 (diameter "A")is suitably large enough to allow a bagel or other particular foodstuff to fit within body 110. For example, diameter "A" may be in a range of approximately 4 inches to 7 inches, and preferably, approximately 5½ inches.

Body 110 is open at its top end to allow tray 310 to be inserted into body 110, but is enclosed at its bottom end by base 104. Base 104 allows for crumbs or other debris from the object being cut to be contained within body 110, thus preventing crumbs from being scattered outside of the cutting apparatus and across the work environment. Debris at the bottom of base 104 may be appropriately discarded, for example through the open top.

A blade guide, suitably formed by a cutting slot 202, may be provided near the top portion of body 110. Cutting slot 202 has a suitable width to receive a cutting blade, such as a bread knife. Cutting slot 202 extends from the front portion of body 110 and across body 110, terminating at a blade stop 114 near the back portion of body 110. Cutting slot 202 is configured to receive a cutting instrument such as a knife and to guide the instrument through the item being cut. Blade stop 114 prevents the blade from exiting out the opposite end of body 110 and thereby inhibits possible injury to the user. Blade stop 114 suitably comprises a protrusion, suitably elliptical, formed integrally into side 118 of body 110. A flange 112 is also suitably formed approximately parallel with the base of cutting slot 202 and extends beyond side 118. Flange 112 suitably provides added stability and ease of use when inserting the knife into cutting slot 202.

Referring now to FIGS. 5 and 6, in an alternative embodiment, body 110 does not include cutting slot 202. Instead, flange 112 is suitably formed around the upper perimeter of body 110. A separate collar piece 160 is provided that when integrated with body 110, forms cutting slot 202 between flange 112 and collar 160.

Collar 160 is suitably comprised of the same material as body 110, though it may be formed of any appropriate material. Collar 160 roughly corresponds to the shape of the body 110, which in this case is substantially cylindrical. In a preferred embodiment, the shape of the inner portion of collar 160 corresponds to the shape of the inner portion of body 110, but the outer portion of collar 160 increasingly narrows as it approaches the entrance of cutting slot 202 so that a portion of flange 112 near the entrance of cutting slot 202 extends radially outward beyond collar 160. This feature allows the user to quickly find the entrance of cutting slot 202 by simply lowering the cutting blade to the point where it makes contact with the protruding portion of flange 112.

Collar 160 may also comprise a cover stop 902 that extends radially inward to prevent a user from forcing cover 610 down past collar 160 and into the plane of cutting slot 202, thereby reducing the possibility of injury to the user's hand or fingers.

Collar 160 may be temporarily or permanently fixed with respect to body 110 according to any appropriate mechanism. For example, body 110 suitably includes a receptacle member 162. Receptacle member 162 may be formed integrally with body, such as adjacent to blade stop 114. Receptacle member 162 suitably includes a pair of recesses 164 formed to receive a pair of prongs 166 extending from collar 160. When prongs 166 are inserted into recesses 164, movement of collar 160 with respect to body 110 is inhibited. Prongs 166 and recesses 164 may be constructed in a manner so that once prongs 166 are slid into recesses 164, they are permanently interconnected; or 166 and 164 may be constructed so that collar 160 and body 110 can be easily dismantled for cleaning.

With continued reference to FIGS. 1–6, body 110 suitably includes an interface for tray 310. For example, body 110 suitably includes a plurality of buttresses 120 positioned in the interior of body 110. Buttresses 120 suitably provide structural support to body 110 as well as provide an interface for tray 310. For example, in a preferred embodiment, body 110 comprises three buttresses 120, each buttress 120 being evenly spaced apart from adjacent buttresses 120. The top of each buttress 120 is equidistant from and parallel to cutting slot 202. Buttresses 120 may be suitably connected to side edge 118 and base 104 for added stability.

Body 110 further suitably includes a mechanism for retaining cover 610. For example, a slot 116 is suitably provided between blade stop 114 and side 118. Slot 116 is configured to receive at least one slat 704 of cover 610 (FIGS. 8A–D), allowing cover 610 to fit onto body 110 and secure objects of various sizes and thicknesses within body 110 and on tray 310. In a preferred embodiment, slat 704 comprises a protruding portion or pin 904 that fits into groove 906 for permitting up and down movement of cover 610 when slat 704 is positioned within slot 116. When cover 610 is fully extended in a vertical position, collar 160 prevents pin 904 from withdrawing from groove 906, but permits cover 610 to tilt back, providing easy access to body 110 and tray 310 and allowing easy insertion and retrieval of the object to be sliced. In the event the user wishes to remove cover 610 from body 110 (e.g. for cleaning the apparatus) the user can remove slat 704 and pin 904 from groove 906 by simply applying pressure and forcing pin 904 inward and then pulling slat 704 out of groove 906.

Body 110 is suitably formed such that the front portion of body 110 (i.e., the side of body 110 in which the knife is initially inserted) is slightly higher than the rear portion of body 110 (i.e., the portion of body 110 nearest blade stop 114) when body 110 is on a flat surface. In this manner, cutting slot 202 tilts in a slight downward direction toward the rear. While a horizontal cut is still made in the object being sliced, the slight downward direction of cutting slot 202 provides a more natural and comfortable cutting motion for the person implementing the knife. In a preferred embodiment, the plane of cutting slot 202 is disposed at an angle "E" with respect to base 104. Angle E is preferably approximately zero to ten degrees and most preferably approximately five degrees.

Skid pads 220 may also be connected to the bottom surface of base 104 for providing friction between base 104 and a surface. Skid pads 220 tend to prevent body 110 from sliding or moving around on a counter or other work surface when an object is being cut. In an alternative embodiment, bottom surface of base 104 may be formed of or coated with a high friction material.

Referring now to FIGS. 7A–D, tray 310 supports the object to be cut within body 110 and is suitably configured to fit within body 110. Tray 310 suitably includes one or more holes 312. Holes 312 facilitate manipulating tray 310 within body 110 as appropriate. Holes 312 also allow crumbs falling from the object being cut to drop through into base 104 of body 110. Crumbs may then be discarded as appropriate.

Tray 310 further comprises at least one protrusion 910 at the surface of tray 310 for engaging and securing an object while it is being cut. Preferably, protrusion 910 has a height of approximately 0.020 to 0.050 inches (most preferably, 0.030 inches).

Tray 310 suitably includes an interface for engaging base 104 or side 118 of body 110. The interface between tray 310 and body 110 suitably facilitates adjustment of the height of tray 310 relative to base 104 of body 110. For example, tray 310 suitably includes a plurality of protrusions 420 formed on the bottom surface of tray 310. Protrusions 420 are appropriately configured to fit over buttresses 120. Protrusions 420 are suitably formed with various depths; protrusions 420 disposed to engage buttresses 120 at the same time have substantially identical depths.

For example, with reference to FIG. 7, protrusions 420A have analogous depths (these depths being different from the depths of protrusions 420B, C, D, or E). Varying the depth of protrusions 420 (by rotating tray 310 within body 110) facilitates positioning tray 310 at various heights within body 110, thus allowing an object to be appropriately raised or lowered for slicing at a desired thickness. The shorter protrusions 420 provide a greater distance from the top of tray 310 to cutting slot 202 (greater thickness at which the object will be sliced) while the deeper protrusions 420 provide less distance from the top of tray 310 to cutting slot 202 (lesser thickness at which the object will be sliced). Of course, one of skill in the art will appreciate that the function of protrusions 420 may also be achieved by using cavities of different depths, the cavities appropriately fitting over buttresses 120.

Protrusions 420A having similar depths are positioned around the circumference of tray 310 in a manner so as to align with buttresses 120 of body 110. For example, if three buttresses 120 are suitably spaced apart from each other by approximately 120°, then tray 310 comprises three protrusions 420A also spaced apart from each other by 120°. In the illustrated embodiment, protrusions 420A have a depth greater than the depths of protrusions 420B–E. Thus, when protrusions 420A are positioned over buttresses 120, tray 310 is positioned at its minimum distance away from cutting slot 202. Tray 310 also comprises sets of protrusions 420B, 420C, 420D, 420E and 420F. Each of protrusions 420B have similar depths, each of protrusions 420C have similar depths, and so on. Each set of protrusions 420 (e.g., 420A, 420B, 420C and so on) is configured to have varying ranges of depths for allowing the user to position tray 310 at varying distances away from cutting slot 202 so that an object may be cut at an appropriate or desired thicknesses.

In a preferred embodiment, visual indicia 912 on top of tray 310 provide a visual indication to the user of the thickness at which the object will be sliced when the corresponding protrusion 420 is positioned over buttress 120. To facilitate the positioning of protrusion 420 over buttress 120, a visual indicia 950 (see FIG. 5D) may also be included along the inside wall of body 110 so that the user is aware of the location of buttress 120 even if tray 310 obscures the user's vision of buttress 120.

Referring now to FIGS. 8A–D, removable cover 610 having an upper surface 620 may fit on top of body 110 and inside collar 160 to hold the object being sliced firmly in place and to allow hands and fingers to be kept away from the cutting edge of the blade. In a preferred embodiment of the present invention, upper surface 620 of cover 610 is curved to fit inside the curvature of the user's palm.

At least one extended cover slat 704 is suitably provided near the back end of cover 610. Slats 704 and pins 904 are suitably configured to fit within slot 116 of body 110. Slats 704, when inserted into slot 116 behind blade stop 114, allow an object being cut to be firmly positioned between cover 610, tray 310 and body 110. Slats 704 may be connected to the underside of cover 610 by suitable means such as a molded connection, a hinged connection, or the like.

The underside of cover 610 includes a plurality of supports 920 to provide stability and strength to cover 610. In a preferred embodiment, protrusions 930 are suitably provided at the intersecting points of supports 920. Protrusions 930 serve a similar role to protrusions 910 on tray 310 in that they engage the object being cut to prevent any movement of the object during the cutting process.

Although the present invention is set forth herein in the context of a method and apparatus for slicing bakery products such as bagels, it should be appreciated that the invention is not limited to the specific forms shown. The present invention may be used to cut any number of different objects or foodstuffs. Further, in light of the foregoing description, it will be apparent to those skilled in the art that various other modifications, variations, and enhancements in the design and arrangement of the present invention may be made. For example, while an exemplary cutting apparatus having distinct parts (e.g., body, tray, cover) has been described herein, individual parts may be integrated together or separated to simplify the design. Thus, a cover may be integrated with the body, a tray may be integrally connected with the body and so on. The invention described herein is intended to embrace all such alternatives, modifications and variations as may fall within the spirit and scope of the appended claims.

What is claimed is:

1. An apparatus for facilitating a cutting of an object, comprising:

a blade guide structure having a cutting slot formed therein;

a receptacle adjacent said blade guide structure and having a cavity formed by a wall and a base, wherein said receptacle includes an opening formed in a top of said receptacle to receive the object;

a tray disposed within the cavity and configured to support a bottom of the object within the cavity, wherein said tray includes an adjustable interface configured to maintain said tray at one of a plurality of selectable positions with respect to the cutting slot; and a cover for engaging an object from an end opposite of said tray; wherein said blade guide structure comprises a flange formed on an upper edge of said receptacle, and wherein said cutting slot is formed between said flange and a collar disposed adjacent to said flange, and wherein said collar comprises a cover stop for preventing said cover from entering said cutting slot.

2. An apparatus according to claim 1, wherein said blade guide structure is formed integrally with said receptacle.

3. The apparatus according to claim 1, wherein said flange extends radially outward beyond said collar near an entrance to said cutting slot.

4. An apparatus according to claim 1, wherein said receptacle includes a tray interface structure configured to adjustably engage said adjustable interface of said tray.

5. An apparatus according to claim 1, wherein said cutting slot is inclined.

6. An apparatus according to claim 1, wherein said blade guide structure includes a blade stop.

7. An apparatus for facilitating a cutting of a foodstuff, comprising:

a hollow, substantially cylindrical body having a wall and a base enclosing a bottom portion of said wall, wherein said wall and said base define a cavity, said cavity has one open end formed by an annular upper portion of said wall through which the foodstuff is disposed, and said body has a cutting slot defined in said wall, wherein said cutting slot is substantially parallel to said open end of said cavity;

a substantially circular tray configured to be disposed within said cavity of said body and having an upper surface and a lower surface, wherein said tray upper surface is configured to support the foodstuff within said cavity of said body;

an interface disposed between said body and said tray, comprising:

a body interface structure disposed within said cavity of said body and substantially rigidly mounted on said body;

a tray interface structure substantially rigidly mounted on said lower surface of said tray and having a plurality of supports, wherein said at least two of said supports correspond to a plurality of positions of said tray relative to said cutting slot, wherein said tray interface structure supports are configured to selectably engage said body interface structure so that at least one of said positions of said tray relative to said cutting slot is maintained; and a substantially circular lid configured to engage the foodstuff opposite said tray, wherein said lid is disposed substantially concentrically with said body, wherein said lid includes a first bracing member; and wherein said body includes a second bracing member configured to engage said first bracing member to prohibit axial movement of said lid relative to said body.

8. The apparatus of claim 7, wherein:

said body interface structure comprises a plurality of buttresses; and said plurality of supports of said tray interface structure comprise a plurality of protrusions extending from said lower surface of said tray, wherein a first protrusion has a first length and a second protrusion has a second length, and said first length is different from said first length, and wherein each of said protrusions includes a mating surface configured to engage one of said buttresses of said body interface structure.

9. An apparatus according to claim 7, wherein said base of said body is skewed with respect to said cutting slot.

10. An apparatus according to claim 7, wherein said first bracing member includes at least one slat and said second bracing member defines a void, wherein said void is configured to receive said slat.

11. An apparatus for facilitating a cutting of a foodstuff, comprising:

a hollow, substantially cylindrical body having a wall and a base, wherein said wall and said base define a cavity, said cavity has an open top end through which the foodstuff is disposed, and said body has an upper surface formed at said open top end of said cavity;

a substantially annular collar having a bottom surface and disposed adjacent to said upper surface of said body, wherein said bottom surface of said collar and said upper surface of said body define a cutting slot;

a substantially circular tray configured to be disposed within said cavity of said body and having an upper surface and a lower surface, wherein said tray upper surface is configured to support a bottom of the foodstuff within said cavity of said body; and an interface disposed between said body and said tray, comprising:

a body interface structure disposed within said cavity of said body and substantially rigidly mounted on said body;

a tray interface structure substantially rigidly mounted on said lower surface of said tray and having a plurality of supports, wherein said at least two of said supports correspond to a plurality of positions of said tray relative to said cutting slot, wherein said tray interface structure supports are configured to selectably engage said body interface structure so that at least one of said positions of said tray relative to said cutting slot is maintained; and a substantially circular lid configured to engage the foodstuff opposite said tray, wherein said lid is disposed substantially concentrically with said body, wherein said lid includes a first bracing member, and wherein said body includes a second bracing member configured to engage said first bracing member to prohibit axial movement of said lid relative to said body.

12. An apparatus according to claim 11, wherein:

said body interface structure comprises a plurality of buttresses; and said plurality of supports of said tray interface structure comprise a plurality of protrusions extending from said lower surface of said tray, wherein a first protrusion has a first length and a second protrusion has a second length, and said first length is different from said first length, and wherein each of said protrusions includes a mating surface configured to engage one of said buttresses of said body interface structure.

13. An apparatus according to claim 11, wherein said base of said body is skewed with respect to said cutting slot.

14. An apparatus according to claim 11, wherein said first bracing member includes at least one slat and said second bracing member defines a void, wherein said void is configured to receive said slat.

* * * * *